United States Patent [19]

Webster

[11] 4,190,268

[45] Feb. 26, 1980

[54] MEANS FOR RECORDING PATIENT CARE

[76] Inventor: David F. Webster, 1325A Edwards Ave., Santa Rosa, Calif. 95401

[21] Appl. No.: 38,340

[22] Filed: May 11, 1979

Related U.S. Application Data

[63] Continuation-in-part of Ser. No. 961,759, Nov. 17, 1978, abandoned.

[51] Int. Cl.[2] ..... B42D 12/02

[52] U.S. Cl. ..... 282/3 R; 283/6

[58] Field of Search ..... 281/5; 282/1, 3 R, 6, 282/DIG. 2; 283/6, 66

[56] References Cited

U.S. PATENT DOCUMENTS

| | | | |
|---|---|---|---|
| 1,634,240 | 6/1927 | Wilford | 282/3 R |
| 2,817,455 | 12/1957 | Farnshaw | 283/66 R |
| 2,869,898 | 1/1959 | Martin | 283/66 A |
| 3,837,682 | 9/1974 | Feller | 282/1 R |
| 3,947,983 | 4/1976 | Bronette | 282/1 R |

FOREIGN PATENT DOCUMENTS

| | | | |
|---|---|---|---|
| 1030178 | 4/1978 | Canada | 283/6 |
| 2639319 | 3/1978 | Fed. Rep. of Germany | 283/66 R |

*Primary Examiner*—Paul A. Bell

*Attorney, Agent, or Firm*—Robert H. Eckhoff

[57] ABSTRACT

Means are provided enabling one to record accurately bedside or in-room nursing care verification developed specifically for acute or extended care facilities with the sole intent of upgrading patient care. Patient confidentiality is assured while the value of the care provided is immediately discernible.

2 Claims, 3 Drawing Figures

MEANS FOR RECORDING PATIENT CARE

This is a continuation-in-part of application Ser. No. 961,759 filed Nov. 17, 1978 now abandoned.

BACKGROUND OF THE INVENTION

Heretofore it has been difficult if not impossible to verify bedside or in-room nursing care. Typical forms heretofore available and generally relating to the field of this invention are disclosed in the patents to Burhans U.S. Pat. No. 875,774, Rosino U.S. Pat. No. 1,225,500, Wilford U.S. Pat. No. 1,634,240, Waltman U.S. Pat. No. 2,236,739, Martin U.S. Pat. No. 2,869,898, Fenberg U.S. Pat. No. 3,130,984, Feller U.S. Pat. No. 3,837,682, Kempster U.S. Pat. No. 3,960,634 and German Pat. No. 2639319.

SUMMARY OF THE INVENTION

The device of the present invention comprises an outer composite cover sheet having a plurality of blank entry strips affixed thereto. Each strip is capable of being peeled off from the composite sheet. The strips extend transversely of the cover sheet in a parallel relationship. The cover sheet is made of a wax paper, cellophane or the like. A sheet of carbon paper is interposed between the cover sheet and a record sheet underlying the cover sheet. In use, one caring for a patient writes upon the first available peel off strip and then peels off that strip. The entry recorded on the record sheet is not available for inspection by unauthorized personnel for all entries are transferred to the sealed backing or record sheet. Any one of the following items can be entered on the record:

1. Patient food intake
2. Bedpan or bathroom assistance extremely helpful for bowel or bladder training
3. Bath time
4. Nursing inspection
5. Patient turning
6. Enema time, etc.
7. Bedding change
8. Decubitus treatment
9. Aids patient evaluation At the end of the shift, the entire record may be inserted in the patient's chart if desired. Each entry includes the exact time and type of care. Frequently two or more patient lights are answered prior to the return of the nurse to the nursing station. Thus, assistance given a patient may not be entered on the record. No dispute is possible as to the time and care, the type of care or the person attending the patient for removal of an entry slip from the chart immediately causes a time sequence break. The next entry time requires accuracy. For example, if entry No. 4 was made at 11:00 a.m. and the strip removed and entry No. 5 indicating turning of the patient, for example, would obviously be inaccurate or even false if it shows it was at an earlier time such as 10:30 a.m.

DESCRIPTION OF THE PREFERRED EMBODIMENT

Figure 1:
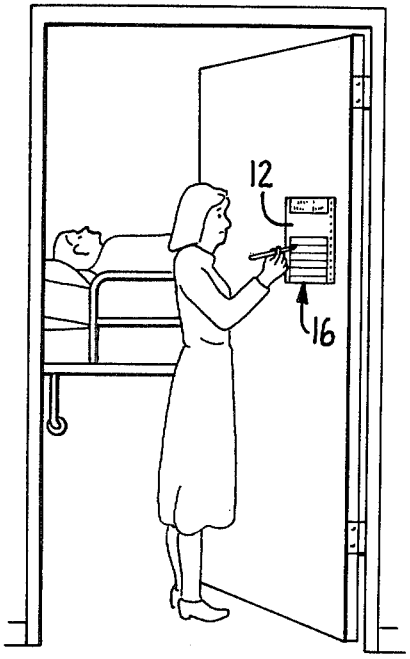
FIG. 1 is a perspective view showing the device in use.

Referring to the drawing, the preferred embodiment includes a base sheet 6 having opposite marginal edges 7 and 8 extending longitudinally of the base sheet and being readily separable from the base sheet. A strip of carbon paper 9 extends over the base sheet between the opposite marginal edges 7 and 8, one edge 11 overlies the marginal edge 7 of the base sheet 6. A cover sheet 12 overlies the carbon strip and the base sheet and having opposite marginal edges 13 and 14 extends longitudinally of said top sheet in a matching relationship to the marginal edges 7 and 8 of the base sheet, being readily separable from the base sheet along with the marginal edges 6 and 7 of the base sheet and the edges 13 and 14 of the cover sheet. The cover sheet 12 is opaque and I have used a waxed paper successfully. On top of the cover sheet 12, I provide a top sheet 16 carrying a plurality of separable strips 17, each extending between the longitudinal marginal edges of the cover sheet. Each strip is lightly secured adhesively to the cover sheet for ready removal from the cover sheet one at a time. The strips 17 are printed with lines 18 for the entry of items to be recorded. The base sheet 6 has lines 19 to define each entry.

Since the cover sheet 12 is opaque, one cannot see what has been entered earlier. The top sheet 16 has at its upper end spaces for the entry of the patient's name, the patient number, the date, and the number of the shift in the 24-hour period.

Figure 2:
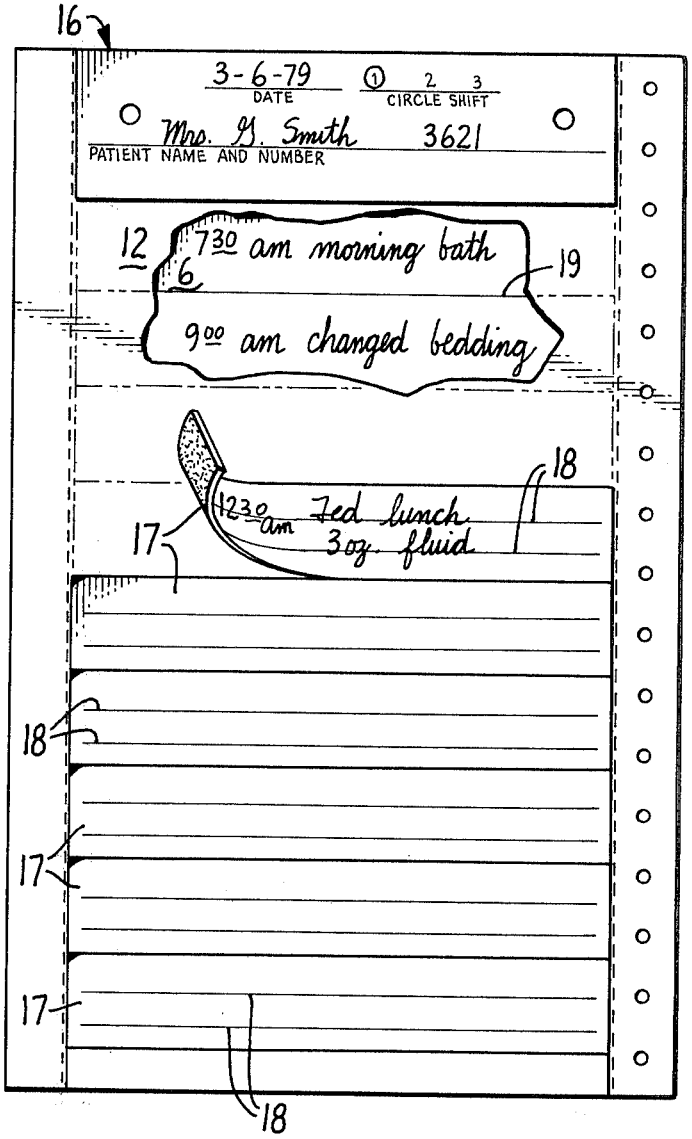
FIG. 2 is a plan view of a composite sheet which has been partially utilized in practicing the invention.
Figure 3:
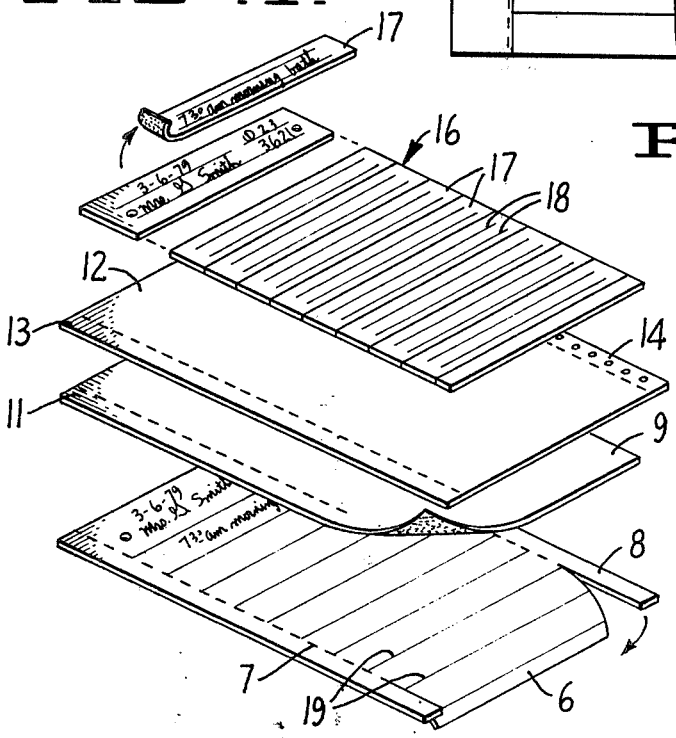
FIG. 3 is a perspective view showing the manner of assembly of the composite sheet.

In use, one responsible for the patient care will make an entry on the uppermost blank strip as in FIG. 1 using a pencil or a ball-point pen of what was done to the patient and when. The strip upon which that person has written is then peeled away as appears in FIG. 2, thus preserving the confidentiality of the patient and forcing the next entry to be made on the next succeeding lower removable strip 17.

At the end of the shift, the entire assembly is removed and a new assembly is provided by the nurse in charge. Thus, the patient confidentiality is maintained at the same time that an accurate time record is provided as to just what was done for the patient, when and by whom.

I claim:

1. Means for recording the care given a patient comprising:

(a) a base sheet having opposite marginal edges extending longitudinally of the base sheet;

(b) a strip of carbon paper extending over the base sheet between the opposite marginal edges;

(c) an opaque cover sheet overlying the carbon strip and the base sheet and having opposite marginal edges extending longitudinally of said top sheet in a matching relationship to the marginal edges of the base sheet and being readily separable from the base sheet;

(d) and a top sheet composed of a plurality of separable strips each extending between the longitudinal marginal edges of the cover sheet and each being lightly secured adhesively to the cover sheet for removal from the cover sheet one at a time.

2. Means for recording the care given a patient comprising:

(a) a base sheet having opposite marginal edges extending longitudinally of the base sheet and being readily separable from the base sheet;

(b) a strip of carbon paper extending over the base sheet between the opposite marginal edges;

(c) an opaque cover sheet overlying the carbon strip and the base sheet and having opposite marginal edges extending longitudinally of said top sheet in a matching relationship to the marginal edges of the base sheet and being readily separable from the base sheet along with the marginal edges of the base sheet and the cover sheet;

(d) and a top sheet composed of a plurality of separable strips each extending between the longitudinal marginal edges of the cover sheet and each being lightly secured adhesively to the cover sheet for removal from the cover sheet one at a time.

* * * * *